United States Patent [19]

Schaub et al.

[11] Patent Number: 4,798,555

[45] Date of Patent: Jan. 17, 1989

[54] TOY POP-UP FIGURE

[75] Inventors: Bernhard Schaub, East Aurora, N.Y.; Steven Taylor, Minnetonka, Minn.

[73] Assignee: The Quaker Oats Company, Chicago, Ill.

[21] Appl. No.: 920,691

[22] Filed: Oct. 17, 1986

[51] Int. Cl.[4] ..... A63H 13/16; A63H 5/00

[52] U.S. Cl. ..... 446/310; 446/419

[58] Field of Search ..... 446/310, 418, 419, 297, 446/309, 303; 272/27 R

[56] References Cited

U.S. PATENT DOCUMENTS 1,707,826 4/1929 Tsobanacos ..... 446/411
2,226,806 12/1940 Chon ..... 446/419 X
3,037,779 6/1962 Duncan ..... 446/310 X
3,538,620 11/1970 Kohner et al. ..... 446/310 X

FOREIGN PATENT DOCUMENTS 142657 1/1951 Australia ..... 446/411

*Primary Examiner*—Mickey Yu
*Attorney, Agent, or Firm*—Cumpston & Shaw

[57] ABSTRACT

A toy pop-up figure, such as a teddy bear or clown, is disclosed having a rotatable cylinder, a pivotally mounted L-shaped member supporting a figure, and a mechanism coupling the cylinder to the L-shaped member for causing the L-shaped member and figure to pop up upon rotation of the cylinder in either direction.

17 Claims, 1 Drawing Sheet

TOY POP-UP FIGURE

BACKGROUND OF THE INVENTION

1. Field of the Invention

This invention relates generally to toys, and more particularly to an improved toy pop-up figure.

2. Description of the Prior Art

Pop-up clown toys are well known in the art in which a crank is rotated in one direction for releasing a cover panel allowing a spring mounted clown to pop-up. Although such toys are attractive to many children, very young children lack the coordination to operate the crank and soon become frustrated and need assistance to operate the toy. Another problem with most of the pop-up toys of this type are that they are not reliable and soon malfunction. Both of these problems have been solved by this invention, which provides a mechanism of improved design that can be operated by young children for reliably releasing and moving a figure to a pop-up position.

SUMMARY OF THE INVENTION

An object of the present invention is to provide an improved toy pop-up figure comprising:

a body;

means rotatably supported by the body;

cover means movably mounted on the body, the cover means supporting a figure and movable between a normal closed position in which the figure is hidden within the body, and a pop-up position in which the figure is displayed;

resilient means for biasing the cover means to its pop-up position;

means for latching the cover means in its closed position; and means coupling the rotatably supported means to the cover means whereby rotation of the rotatably supported means will intermittently release the latching means causing the cover means and figure to be rapidly moved by the resilient means to its pop-up position.

In a more specific object of the invention, the means coupling the rotatably supported means to the cover means comprises a pinion gear mounted on and rotatable with the rotatably supported means, a gear driven by the pinion gear, a radially spaced pin on the driven gear, and a pivotally mounted lever having a follower finger on one end thereof and its opposite end engagable and pivotally movable by the pin. The lever has a pair of laterally outwardly extending arms, the free end portions of which engage fixed abutments under tension for holding the lever in its normal latching position.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
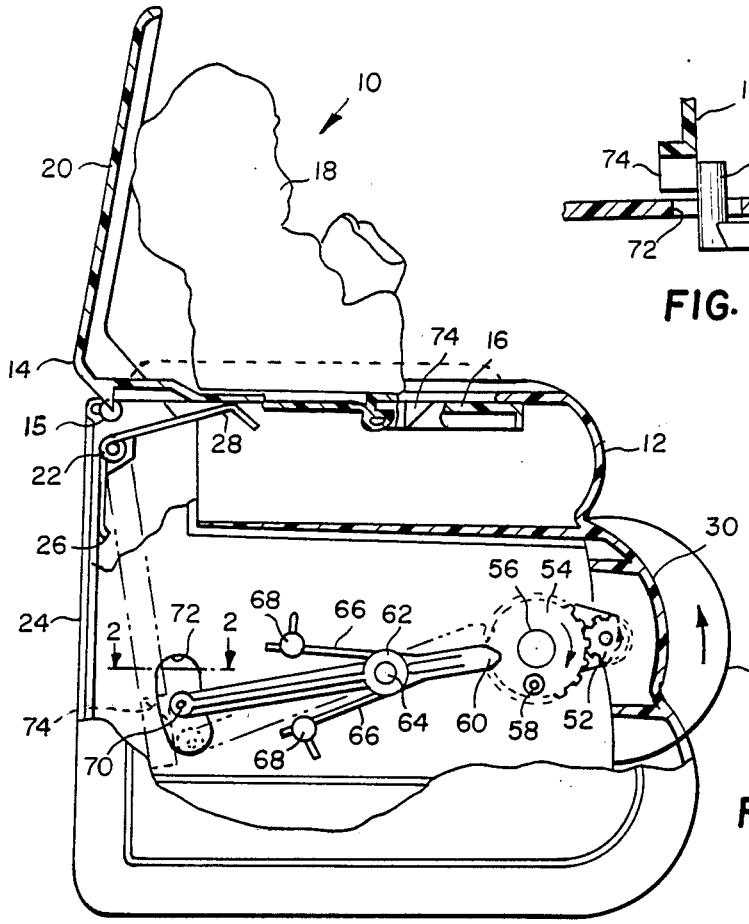
FIG. 1 is a side elevation view partially in section and partially broken away of a preferred embodiment of the toy pop-up figure of this invention.

Referring now to FIG. 1 of the drawings, a preferred embodiment of the toy pop-up FIG. 10 of this invention is disclosed comprising a hollow box-like housing or body 12 for pivotally supporting cover means, such as a substantially L-shaped member 14 about spindles 15, only one of which is shown in FIG. 1. The L-shaped member 14 has a lower flat plate 16 for supporting a toy figure, such as a clown or teddy bear 18 or the like, and an upper flat plate 20 which forms a cover for body 12 when the L-shaped member 14 is in a closed position in which FIG. 18 is hidden within the body. A spring has a coiled mid-section 22 nesting in a slot in the the rear wall 24 of housing or body 12. One straight wire end 26 of the spring bears against wall 24, and its opposite wire end 28 is disposed within a slot in lower plate member 16 and bears against the under surface of the plate member for biasing L-shaped member 14 into the pop-up position shown in FIG. 1, in which FIG. 18 is displayed.

Figure 3:
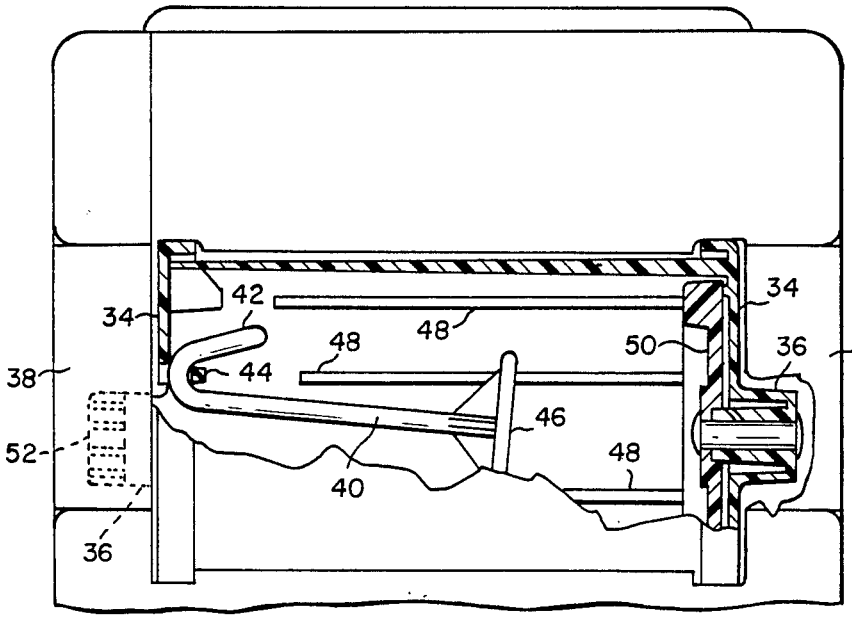
FIG. 3 is a front elevation view of the toy pop-up figure of this invention with a portion of the cylinder broken away.

The front 30 of body 12 rotatably supports a hollow musical cylinder 32, as best seen in FIG. 3. The cylinder has end caps 34 at opposite ends thereof that have stub shafts 36 that are journaled for rotation within side walls 38 of the body. The music making mechanism within cylinder 32 comprises a striking device 40 having a hook 42 at one end hooked through the eye of an eye hook 44 and a striker 46 at the opposite end. A plurality of chime rods 48 of varying length extend from a circular base 50 secured to the opposite side of cylinder 32. When cylinder 32 is rotated, striker 46 sequentially strikes rods 48 generating a pleasant musical chime.

Figure 2:
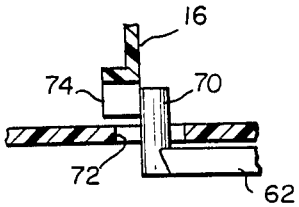
FIG. 2 is a segmental view taken substantially from line 2—2 of FIG. 1.

Means for coupling cylinder 32 to L-shaped member 14 and latching the L-shaped member in its closed position will now be described. The coupling means comprises a pinion gear 52 on one of the stub shafts 36 of cylinder 32 for driving a gear 54 rotatably supported by a post 56 on the body side wall. The driven gear 54 has a radially spaced laterally extending pin 58 which is adapted once for each revolution of gear 54 to strike a V-shaped head end 60 of a lever 62 pivotally mounted on a post 64 on the side wall of the body. The lever 62 has a pair of laterally outwardly extending spring arms 66, the free end portions of which engage fixed abutments 68 on the side of the body. The spring arms 66 engage the fixed abutments under tension for holding lever 62 in a normal latching position, in which a laterally extending finger 70 on the opposite end thereof extending through a slot 72 blocks a right-angled triangular lug 74 laterally extending from a side of plate 16, as best seen in FIGS. 1 and 2. This position is achieved when L-shaped member 14 is manually moved against the bias of spring 28 into its closed position, as shown dotted in FIG. 1. In this position, finger 70 on the end of lever 62 is cammed downwardly out of the path of lug 74, and spring arms 66 return the finger to its normal position blocking the lug and releasably holding L-shaped member 14 in its closed position. Upon movement of cylinder 32 in either direction of rotation, pin 58 will engage the V-shaped head end 60 of lever 62 and pivot it in one or the other direction, withdrawing follower finger 70 out from the path of triangular lug 74, whereupon spring 28 rapidly moves L-shaped member 14 and FIG. 18 to its pop-up position.

While a preferred embodiment of the invention has been shown and described with particularity, it will be appreciated that various changes and modifications may suggest themselves to one having ordinary skill in the art upon being apprised of the present invention. For example, the L-shaped pop-up cover can be replaced with a flat cover that is biased into an open position by a spring within FIG. 18. It is intended to encompass all such changes and modifications as fall within the scope and spirit of the appended claims.

What is claimed is:

1. A pop-up figure toy comprising:

a body having a first surface with an opening therethrough;

cylindrical means rotatably supported by the body on an axis parallel to said surface of said body;

said cylindrical means having a surface portion extending through said opening;

cover means movably mounted on the body, the cover means supporting a figure and movable between a normal closed position in which the figure is hidden within the body, and a pop-up position in which the figure is displayed;

resilient means for biasing the cover means to its pop-up position;

means for latching the cover means in its closed position; and means coupling the cylindrical means to the cover means, whereby rotation of the cylindrical means will intermittently release the latching means causing the cover means and figure to be rapidly moved by the resilient means to its pop-up position.

2. A pop-up figure toy according to claim 1 wherein the latching means comprise a lug on the cover means and a finger on the coupling means.

3. A pop-up figure toy according to claim 2 wherein the coupling means comprise a pinion gear mounted on and rotatable with the cylindrical means, a gear driven by the pinion gear, a radially spaced laterally extending pin on the driven gear, and a pivotally mounted lever having the finger on one end thereof and its opposite end engagable and pivotally movable by the pin.

4. A pop-up figure toy according to claim 3 wherein the lever has a pair of laterally outwardly extending spring arms, the free end portions of which engage fixed abutments under tension for holding the lever in its normal latching position.

5. A pop-up figure toy according to claim 4 wherein the cover means comprises an L-shaped member, wherein the lug has a right-angular triangular shape and extends laterally from one side on the L-shaped member, and the lug is adapted when the L-shaped member is moved to its closed position to cam the finger and lever downwardly against the bias of one of the spring arms, the one spring arm adapted when the lug passes the finger to return the finger and lever to its normal latching position in which the finger blocks the lug.

6. A pop-up figure toy according to claim 5 wherein the finger is moved to unblock the lug, thereby releasing the latching means, upon movement of the cylindrical means in either direction of rotation.

7. A pop-up figure toy according to claim 1 wherein the cylindrical means comprises a hollow cylinder, and wherein music-making means are mounted within the hollow cylinder, the music-making means being actuated upon rotation of the cylinder.

8. A pop-up figure toy according to claim 7 wherein the music-making means comprises a striker secured to a hook on one side of the cylinder, and spaced-apart chime rods of varying length extending from the other side of the cylinder toward the striker.

9. A pop-figure toy comprising a body having a surface with an opening therethrough;

a releasable cover mounted on said body;

means biasing said cover into an open position;

latch means for holding said cover in a closed position;

a figure that is moved into a position at least partially outside of said body when said cover is released;

a cylinder mounted for rotation on an axis parallel to said surface and having a surface portion extending at least partially out of said body through said opening;

means coupled to said cylinder for releasing said latch means when said cylinder is rotated.

10. The pop-up figure toy of claim 9 wherein said cylinder is mounted for rotation in two directions and said means coupled to said cylinder comprises means for releasing said latch means when said cylinder is rotated in either direction.

11. A pop-up figure toy according to claim 10 wherein the latching means comprise a lug on the cover means and a finger on the coupling means.

12. A pop-up figure toy according to claim 11 wherein the coupling means comprise a pinion gear mounted on and rotatable with the cylinder, a gear driven by the pinion gear, a radially spaced laterally extending pin on the driven gear, and a pivotally mounted lever having the finger on one end thereof and its opposite end engagable and pivotally movable by the pin.

13. A pop-up figure toy according to claim 12 wherein the lever has a pair of laterally outwardly extending spring arms in which the free end portions thereof engage fixed abutments under tension for holding the lever in its normal latching position.

14. A pop-up figure toy according to claim 13 wherein the cover means comprises an L-shaped member, wheren the lug has a right-angular triangular shape and extends laterally from one side of the L-shaped member, and the lug is adapted when the L-shaped member is moved to its closed position to cam the finger and lever downwardly against the bias of one of the spring arms, the one spring arm adapted when the lug passes the finger to return the finger and lever to its normal latching position in which the finger blocks the lug.

15. A pop-up figure toy according to claim 14 wherein the finger is moved to unblock the lug, thereby releasing the latching means, upon movement of the cylinder in either direction of rotation.

16. A pop-up figure toy according to claim 10 wherein the cylinder comprises a hollow cylinder, and wherein music-making means are mounted within the hollow cylinder, the music-making means being actuated upon rotation of the cylinder.

17. A pop-up figure toy according to claim 16 wherein the music-making means comprises a striker secured to a hook on one side of the cylinder, and spaced-apart chime rods of varying length extending from the other side of the cylinder toward the striker.

* * * * *